US006473045B1

(12) United States Patent
Duquerroy et al.

(10) Patent No.: US 6,473,045 B1
(45) Date of Patent: Oct. 29, 2002

(54) COAXIAL CONNECTOR ASSEMBLY AND ANTENNA ASSEMBLY HAVING A SWITCHING FUNCTION

(75) Inventors: Patrick Duquerroy, Froschhausen (DE); Blaise Rithener, Vevey (CH); Eric Geoca, Penfield, NY (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 09/901,432

(22) Filed: Jul. 9, 2001

(51) Int. Cl.[7] ..... H01Q 1/24; H01Q 1/50
(52) U.S. Cl. ..... 343/702; 343/906; 439/188
(58) Field of Search ..... 343/702, 906; 439/188, 246, 247, 248, 916

(56) References Cited

U.S. PATENT DOCUMENTS

| | | | | | |
|---|---|---|---|---|---|
| 5,516,303 | A | * | 5/1996 | Yohn et al. | 439/248 |
| 5,625,177 | A | | 4/1997 | Yukinori et al. | |
| 6,142,803 | A | * | 11/2000 | Bozzer et al. | 439/188 |
| 6,224,407 | B1 | * | 5/2001 | Duquerroy et al. | 439/188 |
| 6,241,541 | B1 | * | 6/2001 | Hida | 438/188 |

FOREIGN PATENT DOCUMENTS

| | | | |
|---|---|---|---|
| WO | WO 98/31078 | 7/1998 | H01R/13/631 |

* cited by examiner

*Primary Examiner*—Don Wong
*Assistant Examiner*—Hoang Nguyen

(57) ABSTRACT

The invention provides a coaxial connector assembly comprising a first coaxial connector and a second coaxial connector matable therewith in an axial direction, each connector comprising a mating section having an inner contact surrounded by an outer contact and separated therefrom by a dielectric, the first or second coaxial connectors having a lead-in portion for guiding and locating the connector mating sections of the first and second coaxial connector during plugging together, wherein said inner contact is formed by a resilient metal strip which is integrally formed with a contact portion being adapted to provide a switchable electrical connection with a corresponding counter contact portion depending on the mated or unmated state of the coaxial connector assembly. Furthermore, there is provided an antenna assembly having an integrated switching function, comprising a first coaxial connector being matable with a second coaxial connector in an axial direction, each connector comprising a mating section having an inner contact surrounded by an outer contact separated therefrom by a dielectric, said first or second coaxial connectors having a lead-in portion for guiding and locating the connector mating sections of the first and second coaxial connector during plugging together, and switching means having a common RF input signal terminal and switching the RF signal to either an antenna portion of the assembly or said second connector depending on the unmated or mated state of the assembly, wherein said first coaxial connector is at least partially integrated with said antenna portion.

19 Claims, 5 Drawing Sheets

COAXIAL CONNECTOR ASSEMBLY AND ANTENNA ASSEMBLY HAVING A SWITCHING FUNCTION

BACKGROUND OF THE INVENTION

1. Field of the Invention

The present invention generally relates to the field of coaxial connectors and more specifically to a coaxial connector assembly and an antenna assembly having a switching function, preferably used in a mobile phone.

2. Description of the Related Art

Coaxial connectors having a switching function are for example used in mobile phones to provide a connection option for an external antenna. When the external antenna is connected, an internal antenna of the mobile phone has to be disconnected from respective parts of the mobile phone.

Such a coaxial connector assembly for use in a mobile phone is known from WO 98/31078. FIG. 6 illustrates this prior art connector assembly in an unmated state thereof. The coaxial connector assembly comprises a first connector 1 and a second connector 2. The first connector 1 is mounted on a printed circuit board 5 within a device such as a portable phone having an outer housing 6 for reception in a device such as a telephone cradle 9. Furthermore, the second connector 2 is mounted within the telephone cradle 9 for mating with the first connector 1. Each connector comprises an inner contact 31, 21 surrounded by a respective outer contact 12, 22 being separated from its corresponding inner contact by a dielectric 13, 23. In the illustrated unmated state of the connector assembly a resilient contact arm 32 electrically connects the first and second surface mount contact portions 51 and 52. The inner contact 31 of the first connector 1 is moveable in an axial direction A. Upon mating of the first and second connector, the moveable inner contact 31 is depressed and separates the resilient contact arm 32 from a respective counter contact portion 53. Thereby a switching function is realised, wherein in a first state the first surface mount contact portion 51 and the second surface mount contact portion 52 are connected and in a second state separated from each other.

Furthermore, U.S. Pat. No. 5,625,177 describes a similar first connector which is mounted on a printed circuit board e.g. for testing parts of said printed circuit board when inserting a test probe having a second connector into the first connector. The second connector is of a coaxial type, having an inner conductor which protrudes in an axial (mating) direction and an outer conductor separated from the inner conductor by a dielectric. The first connector comprises a corresponding mating portion and a reversibly moveable spring arm abutting to a first contact portion electrically connected to a first portion of the printed circuit board. The spring arm further is electrically connected to a second portion of the printed circuit board. When the test probe connector is inserted in a direction perpendicular to the board, its protruding inner conductor depresses the spring arm. Thereby the contact between the spring arm and the first contact portion is separated and an electrical contact between the test probe connector and the spring arm is achieved.

During the mating or unmating process these connector assemblies are mechanically heavily stressed. In particular the printed circuit board and the electrical contacts thereto suffer from this mechanical influence.

Furthermore, in the example of the switched internal antenna, independently of the mating state of the assembly, the board is always electrically connected to the internal antenna providing a first RF-signal. As a consequence, when the external antenna in the mated state of the connector assembly provides a second RF-signal, internal antenna transmits unnecessarily its first RF-signal. Additionally, the printed circuit board has to be adapted to be able to provide and possibly shield the RF-signal on its provision from a corresponding interface portion of the board to the switching connector assembly mounted on the board.

SUMMARY OF THE INVENTION

The present invention has been made in consideration of the above disadvantages and has as its first object to provide a coaxial connector assembly with reduced complexity.

It is a second object of the present invention to provide an antenna assembly having a switching function, which is simple in its structure and may be manufactured with less parts and reduced costs.

It is still another object of the present invention to provide an antenna assembly and a coaxial connector assembly adapted to avoid mechanical stress for the printed circuit board and its contacts caused by the mating process.

To achieve these objects, according to a first aspect of the present invention there is provided a coaxial connector assembly comprising a first coaxial connector and a second coaxial connector matable therewith in an axial direction, each connector comprising a mating section having an inner contact surrounded by an outer contact and separated therefrom by a dielectric, the first or second coaxial connectors having a lead-in portion for guiding and locating the connector mating sections of the first and second coaxial connector during plugging together, wherein said inner contact is formed by a resilient metal strip which is integrally formed with a contact portion being adapted to provide a switchable electrical connection with a corresponding counter contact portion depending on the mated or unmated state of the coaxial connector assembly. Thereby the number of parts used in the first connector can be reduced and a corresponding assembly process becomes simplified.

In a preferred embodiment of the first aspect of the invention the inner contact of the resilient metal strip has a U-shaped form. This specific form stabilizes the resilient metal strip and additionally provides a rounded contact portion at its tip.

In a further preferred embodiment of the first aspect of the invention said resilient metal strip comprises a first contact leg having said contact portion arranged at its free end. By means of the first contact leg a small movement of the inner contact of said resilient metal strip may be transformed into a suitable movement of the contact portion of the resilient metal strip for separating same from the corresponding counter contact portion. Furthermore, the arrangement of the counter contact portion becomes more flexible by using the first contact leg.

In a preferred embodiment of the first aspect of the invention said resilient metal strip further comprises a second contact leg, having at its free end a second contact portion for providing an electrical connection to a printed circuit board (PCB). This form of an electrical contact is easy to manufacture and can be realised without soldering. Additionally, this structure can be realised without a corresponding mechanical connection to the board and thus allows to avoid the mechanical stress in the mating or unmating process.

An advantageous embodiment of the first aspect of the invention is achieved when each of said mating section of said first and second connector has a mating face opposing each other in the mated state of the connector assembly, wherein said metal strip extends in the axial direction through said first connector to protrude from the mating face thereof. Thereby a second connector without a protruding inner contact becomes suitable for use in the connector assembly.

A further advantageous embodiment of the first aspect of the invention is achieved when the inner contact of said second connector has a recess formed in its axial face to abut the tip of said protruding metal strip in the mated state of the connector assembly. Such a recess mechanically fixes said protruding metal strip in a radial direction.

According to a second aspect of the invention there is provided an antenna assembly having an integrated switching function, comprising a first coaxial connector being matable with a second coaxial connector in an axial direction, each connector comprising a mating section having an inner contact surrounded by an outer contact and separated therefrom by a dielectric, said first or second coaxial connectors having a lead-in portion for guiding and locating the connector mating sections of the first and second coaxial connector during plugging together, and switching means having a common RF input signal terminal and switching the RF signal to either an antenna portion of the assembly or said second connector depending on the unmated or mated state of the assembly, wherein said first coaxial connector is at least partially integrated with said antenna portion. Compared to the known connector assemblies, this antenna assembly having an integrated switching function provides a switched RF-signal. Hence, the RF-signal is only provided where needed and additional interface portions and transmission lines on a printed circuit board can be avoided. Furthermore, the compatibility and flexibility with respect to additional electrical units is improved.

In a preferred embodiment of the second aspect of the invention said inner contact is formed by a resilient metal strip which is integrally formed with a contact portion abutting to a contact of said antenna portion. Thereby the number of parts used in the assembly is further reduced.

An advantageous embodiment of the second aspect of the invention is achieved when said antenna portion and said first coaxial connector is formed by a single molded integrated device. Thereby, the number of parts used in the antenna assembly and its overall size is further reduced and its assembly process is simplified.

In a further preferred embodiment of the second aspect of the invention said resilient metal strip has a U-shaped form, for providing a stable inner contact and a rounded contact portion at its tip.

A further advantageous embodiment of the second aspect of the invention is achieved when said switching means comprises a first contact leg having said contact portion arranged at its free end. Thereby, the arrangement of the counter contact portion becomes flexible and moreover a small movement of said inner contact of said resilient metal strip can be transformed into a suitable movement of the contact portion arranged at the end of first contact leg.

In a further preferred embodiment of the second aspect of the invention said switching means comprises a second resilient contact leg, having at its free end said common RF signal terminal for providing an electrical connection to a printed circuit board (PCB). This electrical connection is flexible and can be realised without soldering. Additionally, it requires no corresponding mechanical connection to the board and thus allows to avoid the mechanical stress in the mating or unmating process.

In an advantageous preferred embodiment of the second aspect of the invention the second coaxial connector is connected to an external antenna, wherein the antenna portion forms an internal antenna. Thereby an internal antenna switching Finally, according to a third aspect, the invention provides a telephone comprising a housing, a printed circuit board and a connector assembly according to the first aspect of the invention or an antenna assembly according to the second aspect of the invention, wherein said connector or antenna assembly and said printed circuit board are sustained by said housing.

BRIEF DESCRIPTION OF THE DRAWINGS

The accompanying drawings are incorporated into and form a part of the specification to illustrate several embodiments of the present invention. These drawings together with the description serve to explain the principles of the invention. The drawings are only for the purpose of illustrating preferred and alternative examples of how the invention can be made and used and are not to be construed as limiting the invention to only the illustrated and described embodiments. Further features and advantages will become apparent from the following and more particular description of the various embodiments of the invention, as illustrated in the accompanying drawings,.wherein.

DETAILED DESCRIPTION OF THE INVENTION

Figure 1:
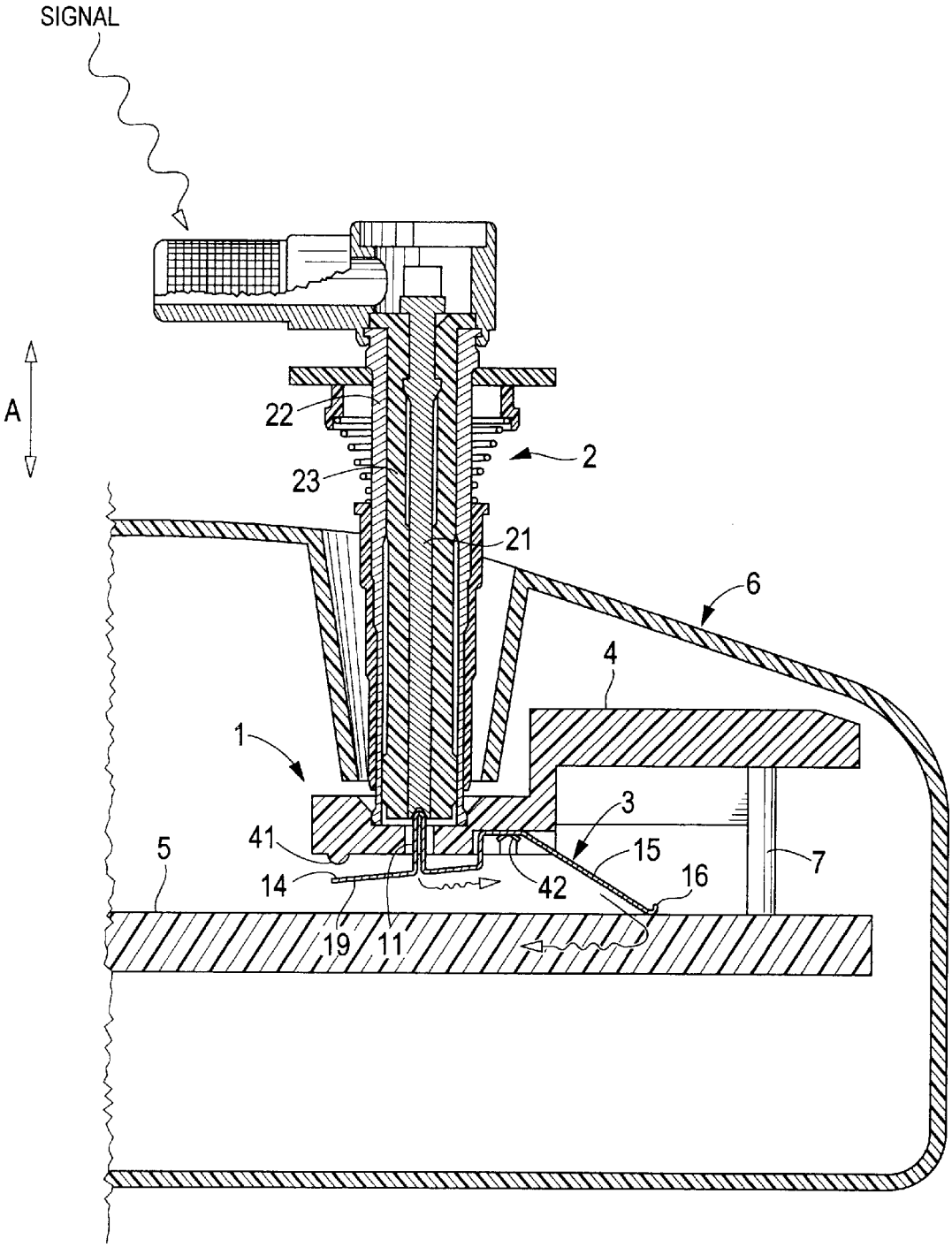
FIG. 1 is a cross sectional view of a coaxial connector assembly according to the invention in the mated state of the assembly.

The illustrated embodiments of the present invention will now be described with reference to the figure drawings wherein like elements and structures are indicated by like reference numbers.

Referring now to the drawings and particularly to FIGS. 1 to 4, a first preferred embodiment of a coaxial connector assembly and an antenna assembly is described in detail. For the general details of the illustrated connector assembly it is referred to the above-mentioned document WO 98/31078.

Figure 2:
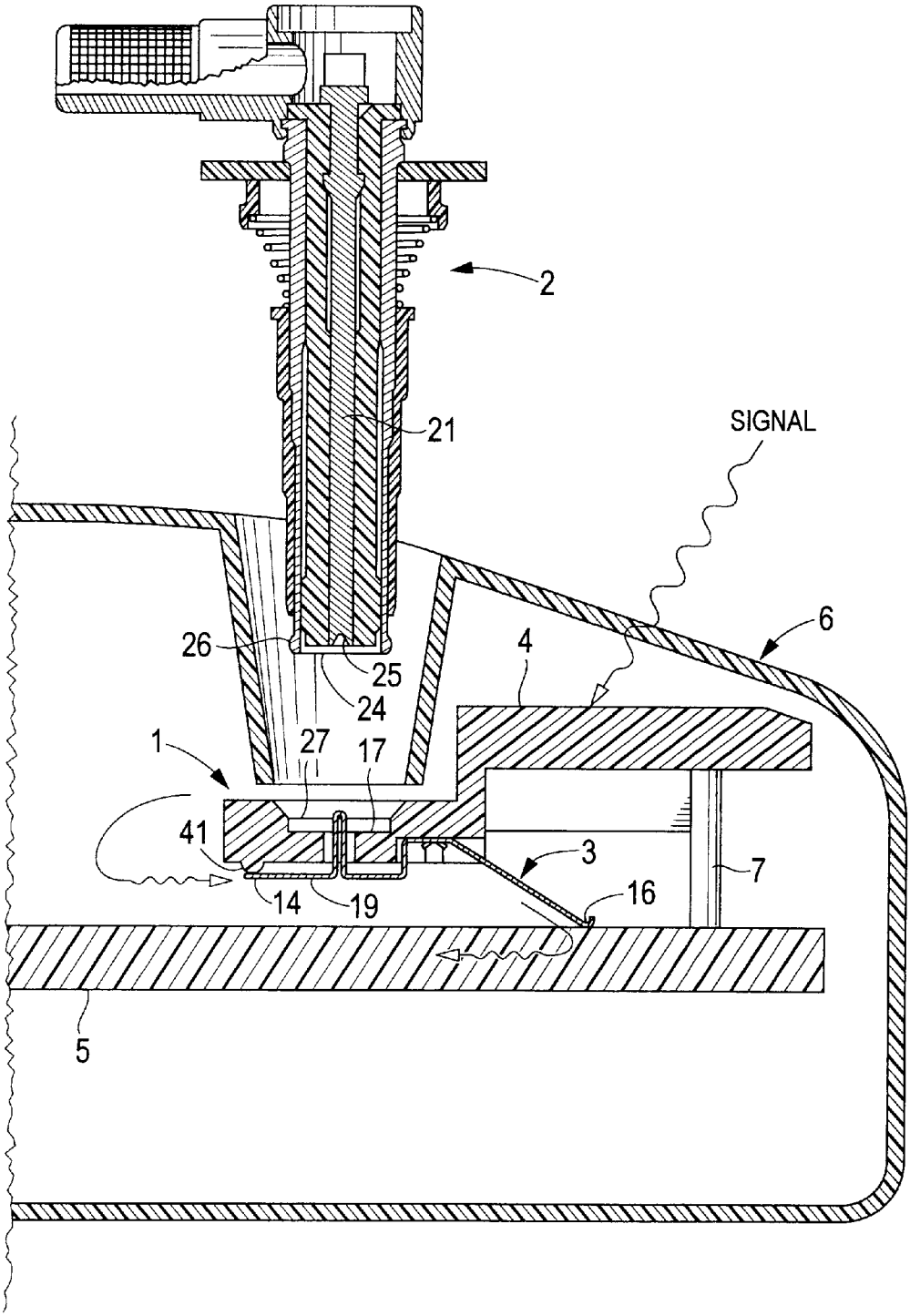
FIG. 2 is a cross sectional view illustrating the assembly of FIG. 1 in an unmated state thereof.

FIG. 1 and 2 illustrate the coaxial connector assembly in a mated and an unmated state respectively. There is provided a first coaxial connector 1 and a second coaxial connector 2 matable with each other in an axial direction A. The coaxial connector assembly is arranged in a housing 6 of a mobile phone further comprising a printed circuit board 5 and an internal antenna or antenna portion 4. The first connector being mechanically fixed to the circuit board 5 via the internal antenna 4 and the connecting means 7.

An incoming RF-signal is received in the internal antenna 4 and provided to the printed circuit board 5 via a resilient metal strip 3. The arrows in FIG. 2 indicate a signal flow of the received RF-signal. The metal strip is integrally formed with a contact portion 14 being adapted to provide a switchable electrical connection with a corresponding counter contact portion 41. In the unmated state of the assembly the contact portion 14 abuts to the counter contact portion 41, which is electrically connected to the internal antenna 4. Finally, a signal terminal 16 of the metal strip 3 provides the RF-signal to the PCB 5. Reference numbers 27 and 26 indicate the mating sections of the first and second coaxial connectors respectively.

Figure 3:
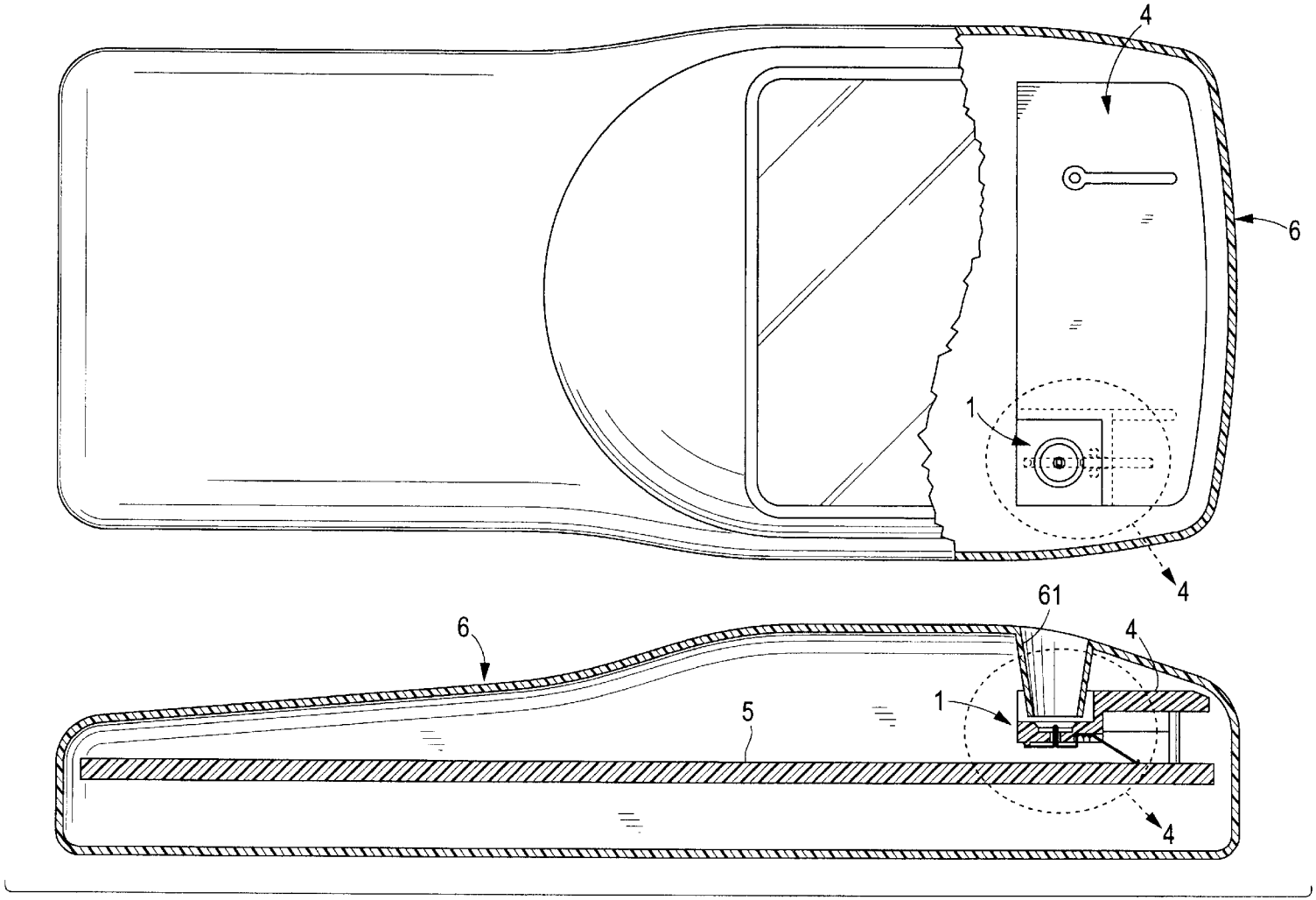
FIG. 3 is a side and a top cross sectional view illustrating the arrangement of the assembly according to FIGS. 1 and 2 in a mobile phone housing.

FIG. 3 illustrates the arrangement of the coaxial connector assembly or the antenna assembly in the housing 6 of a mobile phone. The top view illustrates in its cross sectional part the internal antenna 4 and the first coaxial connector 1. Furthermore, in the corresponding cross sectional side view shown in the lower part of FIG. 3, the printed circuit board 5 as well as a lead in portion 61 of the mobile phone's housing 6 are illustrated.

Figure 4:
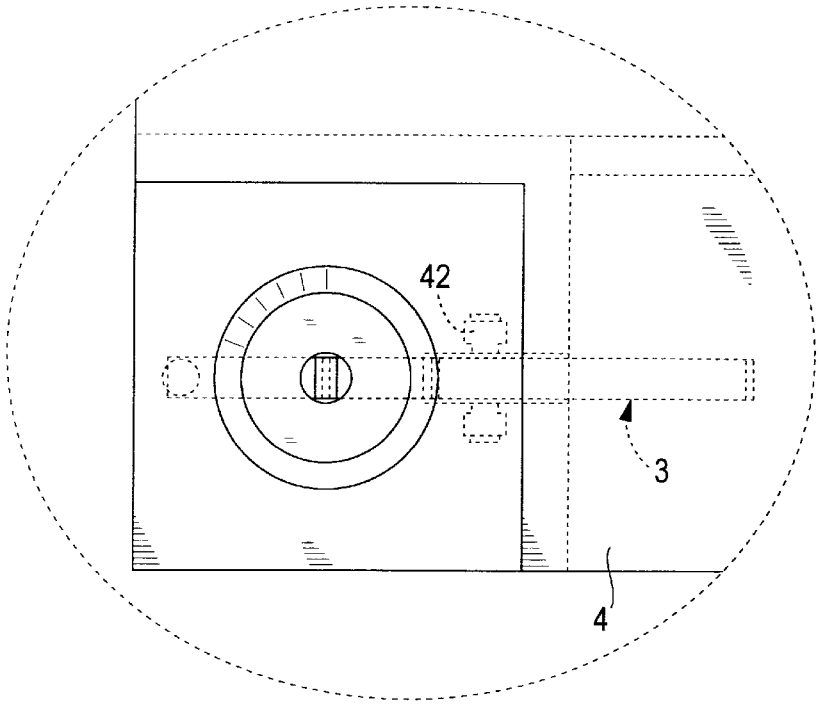
FIG. 4 is a more detailed view of the relevant portions of FIG. 3.
Figure 4:
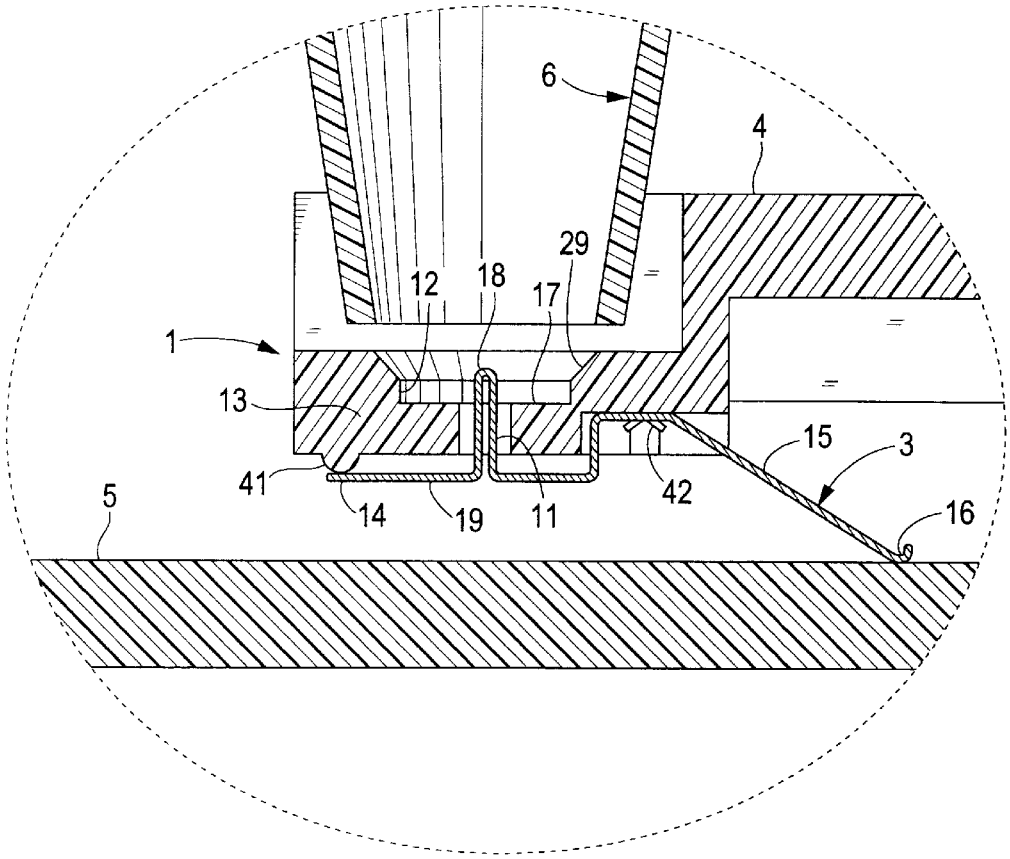

FIG. 4 shows a more detailed view of the relevant parts of FIG. 3, wherein the first coaxial connector 1 comprises the resilient metal strip 3, being mechanically fixed to the first connector 1 through fixing means 42. The resilient metal strip 3 forms an inner contact 11 of the first coaxial connector 1 and preferably has a U-shaped form. Furthermore, it protrudes with its tip 18 from a mating face 17 of the first coaxial connector 1. The first connector 1 further comprises a non-illustrated ground or outer contact portion at a position 12 being separated from the inner connector by a dielectric 13.

The inner contact 11 of the resilient metal strip 3 is movable in an axial direction. Accordingly, the first connector may be adapted to allow a corresponding movement of the inner contact 11 by providing a gap between the inner contact 11 and the dielectric 13. Therein, the gap may also at least partly form the dielectric 13. The first coaxial connector 1 further comprises a lead-in portion 29 for guiding and locating the connector mating sections during plugging together.

Preferably, the inner contact 21 of the second coaxial connector 2 (FIG. 2) has a recess 25 formed in its axial face 24 to abut or house the tip 18 of the protruding metal strip in the mated state of the assembly.

As illustrated in FIG. 1 in the mated state of the connector assembly an inner contact 21 of the second connector 2 comes into contact with the tip 18 of the inner contact 11 of the resilient metal strip 3. The second connector further comprises an outer contact 22 which is separated from its inner contact 21 by a dielectric 23. In the mated state the respective mating faces of the first and second connector oppose each other.

The resilient metal strip 3 is at least partly moveable in an axial direction to provide a switching function between a signal from the second connector 2 or the internal antenna 4. Upon mating of the first 1 and second 2 coaxial connector the inner contacts 11 of the resilient metal strip is depressed so as to separate its contact portion 14 from the counter contact portion 41. Thereby in the mated state of the connector assembly an external RF-signal arriving from the second connector is transferred to the PCB 5 via the resilient metal strip as indicated by the arrows in FIG. 1.

Preferably the metal strip 3 has the contact portion 14 at a free end of a first contact leg of the metal strip 3. Furthermore, in an advantageous embodiment the contact portion or RF input signal terminal 16 of the resilient metal strip is embodied at a free end of a resilient second contact leg 15 of the metal strip 3.

Furthermore, the fixing means 7 may be used to clip or screw the antenna assembly to the PCB and may be adapted to provide a flexible mechanical connection the PCB to further improve the mechanical coupling to the connector assembly. Finally, the ground contact or outer contact 12 of the first connector may be electrically connected to the PCB 5 either by pressing or soldering via the fixing means 7 or with a small spring soldered on the PCB 5.

An antenna assembly according to the invention comprises the first coaxial connector 1, the antenna portion 4 and the resilient metal strip 3. Therein, essentially the resilient metal strip 3 forms the switching means to provide the switching function in the antenna assembly. As it is apparent for a skilled person the same above-mentioned advantage for the antenna assembly may be achieved with common switching means. The switching means or resilient metal strip has the contact portion 16 as a common RF input signal terminal. The first coaxial connector is matable with a second coaxial connector 2. Depending on a corresponding mated or an unmated state of the antenna assembly the RF signal is switched to either the antenna portion 4 or the second connector 2.

Figure 5:
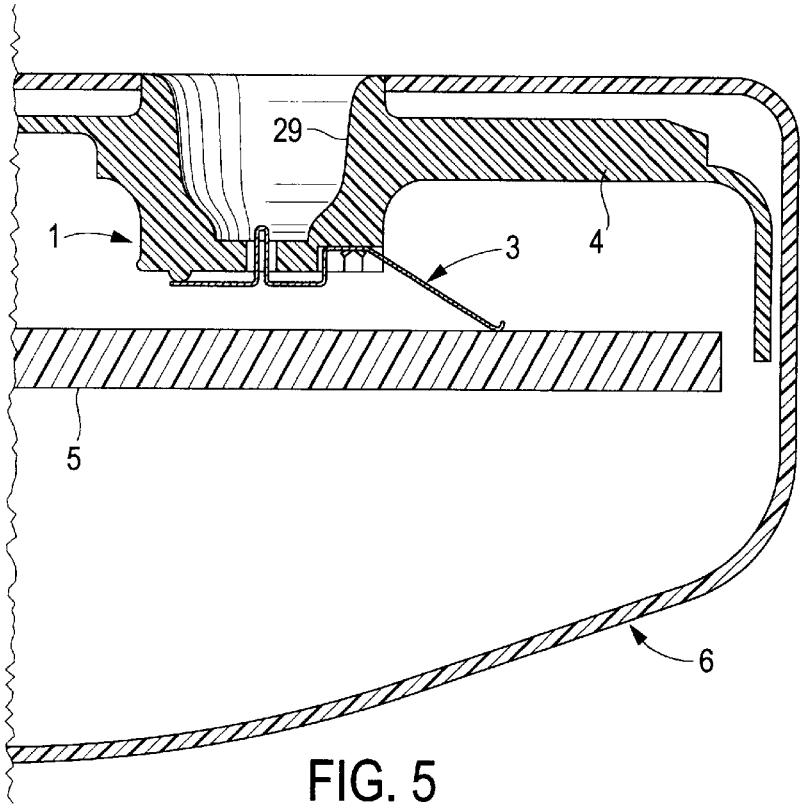
FIG. 5 is a cross sectional view of an antenna assembly according to a further embodiment of this invention.
Figure 6:
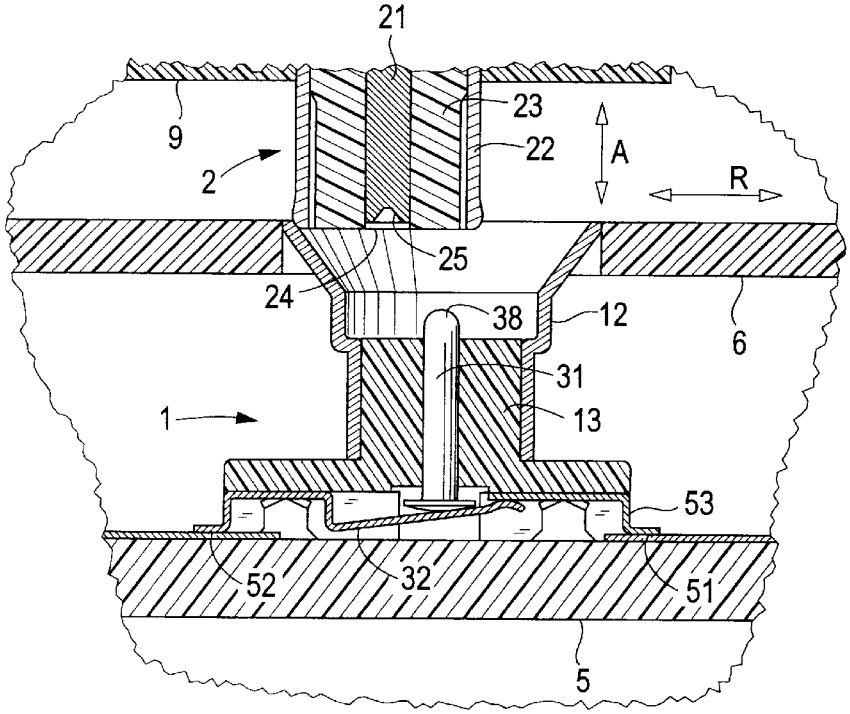
FIG. 6 PRIOR ART
FIG. 6 is a cross sectional view of a prior art coaxial connector assembly in its unmated state.

FIG. 5 illustrates a second embodiment for the present invention. Since most of the details illustrated therein are identical to the first embodiment basically the differences thereto will be described in more detail.

The antenna portion 4 is equally integrally formed with the first connector 1, but according to this embodiment mechanically fixed to the housing 6. Hence, no direct mechanical connection to the PCB 5 exists and corresponding mechanical stress only indirectly effects the PCB 5 by means of the housing 6. The electrical connection to the PCB 5 again is realised by the resilient metal strip 3 as illustrated for the first embodiment of the invention. A further difference to the first embodiment is the modified lead-in area 29 of the first connector 1, thereby avoiding the need for a lead-in area 61 of the housing 6.

As will be apparent for a person skilled in the art, the following improvements lead to further preferred embodiments for the first as well as the second embodiment.

In a modification of the above embodiments, the first coaxial connector 1 and the antenna portion 4 may be formed as a single molded integrated device. Therein the antenna assembly is essentially formed by one part made out of two different plastic parts wherein one of the plastic parts is covered by a conducting layer e.g. nickel layer, the other plastic part being non-covered.

Moreover, the contact portion 14 of the resilient metal strip 3 may also be arranged in between the fixed portion thereof and the inner contact 11. The axial movement of the resilient metal strip 3 still would be suitable to separate the contact portion 14 from the correspondingly arranged counter contact portion 41. Finally, the second coaxial connector may be connected to an external antenna e.g. a car kit or a test probe in a production line.

While the invention has been described with respect to the preferred physical embodiments constructed in accordance therewith, it will be apparent to those skilled in the art that various modifications, variations and improvements of the present invention may be made in the light of the above teachings and within the preview of the appended claims without departing from the spirit and intended scope of the invention.

In addition, those areas in which it is believed that those of ordinary skilled in the art are familiar, have not been described herein in order to not unnecessarily obscure the invention described herein. Accordingly, it is to be understood that the invention is not to be limited by the specific illustrative embodiments, but only in the scope of the appended claims.

What is claimed is:

1. A coaxial connector assembly comprising a first coaxial connector and a second coaxial connector matable therewith in an axial direction, each connector comprising a mating section having an inner contact surrounded by an outer contact and separated therefrom by a dielectric, the first or second coaxial connectors having a lead-in portion for guiding and locating the connector mating sections of the first and second coaxial connector during plugging together, wherein said inner contact is formed by a resilient metal strip which is integrally formed with a contact portion being adapted to provide a switchable electrical connection with a corresponding counter contact portion depending on the mated or unmated state of the coaxial connector assembly.

2. The coaxial connector assembly according to claim 1, wherein said inner contact of said resilient metal strip has a U-shaped form.

3. The coaxial connector assembly according to claim 1, wherein said resilient metal strip comprises a first contact leg having said contact portion arranged at its free end.

4. The coaxial connector assembly according to claim 1, wherein said resilient metal strip further comprises a second contact leg, having at its free end a second contact portion for providing an electrical connection to a printed circuit board (PCB).

5. The coaxial connector assembly according to claim 1, wherein each of said mating sections of said first and second connector has a mating face opposing each other in the mated state of the connector assembly, said metal strip extending in the axial direction through said first connector to protrude from the mating face thereof.

6. The coaxial connector assembly according to claim 5, wherein the inner contact of said second connector has a recess formed in its axial face to abut the tip of said protruding metal strip in the mated state of the connector assembly.

7. The coaxial connector assembly according to claim 1, wherein said first connector comprises fixing means for fixing said resilient metal strip.

8. A telephone comprising a housing, a printed circuit board and a connector assembly according to claim 1 wherein said connector assembly and said printed circuit board are sustained by said housing.

9. An antenna assembly having an integrated switching function, comprising a first coaxial connector being matable with a second coaxial connector in an axial direction, each connector comprising a mating section having an inner contact surrounded by an outer contact and separated therefrom by a dielectric, said first or second coaxial connectors having a lead-in portion for guiding and locating the connector mating sections of the first and second coaxial connector during plugging together, and switching means having a common RF input signal terminal and switching the RF signal to either an antenna portion of the assembly or said second connector depending on the unmated or mated state of the assembly, wherein said first coaxial connector is at least partially integrated with said antenna portion.

10. The antenna assembly according to claim 9, wherein said inner contact is formed by a resilient metal strip which is integrally formed with a contact portion abutting to a contact of said antenna portion.

11. The antenna assembly according to claim 9, wherein said inner contact of said resilient metal strip has a U-shaped form.

12. The antenna assembly according to claim 10, wherein each of said mating sections of said first and second connector has a mating face opposing each other in the mated state of the connector assembly, said metal strip extending in the axial direction through said first connector to protrude from the mating face thereof.

13. The antenna assembly according to claim 12, wherein the inner contact of said second connector has a recess formed in its axial face to abut the tip of said protruding metal strip in the mating state of the assembly.

14. The antenna assembly according to claim 9, wherein said antenna portion and said first coaxial connector are formed by a single molded integrated device.

15. The antenna assembly according to claim 9, wherein said switching means comprises a first contact leg having said contact portion arranged at its free end.

16. The antenna assembly according to claim 10, wherein said switching means further comprises a second resilient contact leg, having at its free end said common RF signal terminal for providing an electrical connection to a printed circuit board (PCB).

17. The antenna assembly according claim 9, wherein said first connector comprises fixing means for fixing said switching means.

18. The antenna assembly according to claim 9, wherein the second connector is connected to an external antenna, the antenna portion forming an internal antenna.

19. A telephone comprising a housing, a printed circuit board and an antenna assembly according to claim 9, wherein said antenna assembly and said printed circuit board are sustained by said housing.

* * * * *